US011412820B2

(12) United States Patent
Prasitkittanai et al.

(10) Patent No.: US 11,412,820 B2
(45) Date of Patent: Aug. 16, 2022

(54) JEWELRY CLASP

(71) Applicants: Pandora A/S, Copenhagen (DK); Pandora Production Co., Ltd., Bangkok (TH)

(72) Inventors: Issaree Prasitkittanai, Bangkok (TH); Patpakorn Duangnaophio, Khonkaen (TH); Chaowalit Chotladakamonthat, Ayuttyhaya (TH)

(73) Assignees: PANDORA A/S, Københavnv (DK); PANDORA PRODUCTION CO., LTD., Bangkok (TH)

( * ) Notice: Subject to any disclaimer, the term of this patent is extended or adjusted under 35 U.S.C. 154(b) by 0 days.

(21) Appl. No.: 17/303,266

(22) Filed: May 25, 2021

(65) Prior Publication Data

US 2021/0368949 A1 Dec. 2, 2021

(30) Foreign Application Priority Data

May 27, 2020 (EP) ..... 20176864

(51) Int. Cl.
*A44C 5/20* (2006.01)

(52) U.S. Cl.
CPC ..... *A44C 5/2066* (2013.01); *A44D 2203/00* (2013.01)

(58) Field of Classification Search
CPC .. A44C 5/2066; A44C 5/2071; A44D 2203/00
See application file for complete search history.

(56) References Cited

U.S. PATENT DOCUMENTS

| | | | | |
|---|---|---|---|---|
| 269,156 | A | 12/1882 | Campbell | |
| 2,946,237 | A | 7/1960 | Hebert | |
| 3,187,602 | A | 6/1965 | Geoffrey | |
| 3,766,346 | A | 10/1973 | Alexander | |
| 4,161,637 | A | 7/1979 | Priesemuth | |
| 4,924,562 | A | 5/1990 | Pogharian | |
| 5,008,984 | A * | 4/1991 | Levy | A44C 5/2042 24/616 |
| 5,050,276 | A | 9/1991 | Pemberton | |
| 5,197,168 | A * | 3/1993 | Levy | A44C 5/2042 24/616 |

(Continued)

FOREIGN PATENT DOCUMENTS

| | | | |
|---|---|---|---|
| CH | 255179 | A | 6/1948 |
| CH | 262362 | A | 6/1949 |

(Continued)

*Primary Examiner* — Robert Sandy
(74) *Attorney, Agent, or Firm* — Avek IP, LLC

(57) ABSTRACT

A jewelry clasp for securing a first end of an elongated member of a bracelet or a necklace to a second end of the elongated member includes a female part and a male part. One of the female and male parts includes a first magnet and the other of the female and male parts includes a part magnetically attractable by the first magnet. The female part includes a housing and a hinged lid, the hinged lid being pivotable between a locking state and a releasing state and including the first magnet or the part magnetically attractable by the first magnet. When the female part is open, the male part can be inserted in an axial direction into the housing, and when the female part is closed and the male part is inserted into the housing, the male part is locked to the female part.

11 Claims, 4 Drawing Sheets

(56) References Cited

U.S. PATENT DOCUMENTS

| | | | | |
|---|---|---|---|---|
| 5,722,260 | A | 3/1998 | Mangano | |
| 6,145,171 | A | 11/2000 | Hoshino | |
| 6,260,381 | B1 | 7/2001 | Zettl | |
| 6,484,376 | B1 | 11/2002 | Khatchadourian et al. | |
| 6,508,080 | B1 | 1/2003 | Ninomiya | |
| 6,591,462 | B2 | 7/2003 | Fuhrman | |
| 7,073,232 | B1 * | 7/2006 | Fuhrman | A44C 5/2042 24/303 |
| 7,322,076 | B2 | 1/2008 | Ninomiya | |
| 7,334,433 | B1 * | 2/2008 | Fuhrman | A44C 5/2042 63/3 |
| 7,690,088 | B2 * | 4/2010 | Kogen | A44C 5/2076 24/616 |
| 7,878,024 | B2 | 2/2011 | Baik | |
| 8,209,824 | B2 | 7/2012 | Fuhtman | |
| 8,661,627 | B2 * | 3/2014 | Fuhrman | F16B 2/20 24/303 |
| 9,101,185 | B1 | 8/2015 | Greenberg | |
| 9,326,569 | B1 | 5/2016 | Cipolla | |
| 9,609,921 | B1 | 4/2017 | Feinstein | |
| 9,743,725 | B2 | 8/2017 | Hines et al. | |
| 9,924,751 | B2 | 3/2018 | King | |
| 2002/0112323 | A1 | 8/2002 | Nire | |
| 2005/0183249 | A1 | 8/2005 | Ninomiya | |
| 2005/0188512 | A1 | 9/2005 | Ninomiya | |
| 2007/0240452 | A1 | 10/2007 | Beard | |
| 2014/0000068 | A1 | 1/2014 | Casini | |
| 2015/0216269 | A1 | 8/2015 | Fuhrman et al. | |
| 2016/0058136 | A1 | 3/2016 | Ng | |
| 2016/0113360 | A1 | 4/2016 | Hines et al. | |

FOREIGN PATENT DOCUMENTS

| | | | |
|---|---|---|---|
| CH | 676073 | | 6/1991 |
| CN | 205390592 | U | 7/2016 |
| CN | 207506048 | U | 6/2018 |
| DE | 439480 | C | 1/1927 |
| DE | 202012103179 | U1 | 9/2012 |
| DE | 202014001624 | U1 | 5/2015 |
| DE | 102016100631 | A1 | 12/2016 |
| ES | 1064132 | | 5/2007 |
| FR | 2418632 | A1 | 9/1979 |
| IT | VI20110223 | A1 | 2/2013 |
| JP | H03284216 | A | 12/1991 |
| JP | H09182609 | A | 7/1997 |
| JP | H09238721 | A | 9/1997 |
| JP | H11235220 | A | 8/1999 |
| JP | 2003230413 | A | 8/2003 |
| JP | 2005230461 | A | 9/2005 |
| JP | 2005230462 | A | 9/2005 |
| JP | 5191912 | B2 | 5/2013 |
| JP | 5816417 | B2 | 11/2015 |
| KR | 101426023 | B1 | 8/2014 |
| WO | 2002032249 | A2 | 4/2002 |
| WO | 2012117577 | A1 | 9/2012 |
| WO | 2015128074 | A1 | 9/2015 |
| WO | 2016069565 | A1 | 5/2016 |

* cited by examiner

JEWELRY CLASP

CROSS-REFERENCE TO RELATED APPLICATIONS

This application claims the benefit of priority of EP Application No. 20176864.5, filed May 27, 2020, the entire disclosure of which is incorporated by reference in its entirety.

TECHNICAL FIELD

The disclosure relates to jewelry clasps for securing a first end of an elongated member of a bracelet or a necklace to a second end of the elongated member.

BACKGROUND ART

Jewelry, such as bracelets and necklaces, traditionally comprises ornamental components, e.g. beads or charms, strung on one or more elongated members. An elongated member may be a chain, wire, string, thread, chord, or the like. Such bead-carrying jewelry has been known since antiquity. Ends of the elongated member are traditionally attached together permanently to prevent the one or more beads from falling off. However, when worn by a user today, the ends of an elongated member of modern jewelry are typically temporarily attached to each other by means of a jewelry clasp. Such jewelry clasps are commonly used in bracelets and necklaces.

With some prior art jewelry clasps, locking and unlocking the jewelry clasp without requiring the assistance of a second person may be difficult. This may especially be the case for bracelets worn on the wrist since this often leaves only the other hand for engaging the jewelry clasp, but this may also be perceived as a problem in other types of jewelry, such as necklaces. Therefore, some users prefer jewelry clasps that may easily be locked and unlocked using only one hand without imposing a risk for accidental separation of the ends of the piece of jewelry when the jewelry is worn.

Some prior art jewelry clasps consist of a loop attached to one end of the jewelry piece and a connecting member located at the opposite end. The connecting member typically includes a spring-biased arm or latch that is movable from a closed position to an open position to enable the loop to be positioned within the connecting member. However, these clasps are often difficult to grasp, depress and operate due to their small size.

A jewelry clasp disclosed in WO 02/32249 A2 includes a female member with a pivotally mounted latch and a male member, respectively connected to ends of an elongated member.

Other prior art jewelry clasps include magnets for providing or assisting in the releasable attachment of the ends of the elongated members to each other. The magnetic forces keeping the ends together may be relatively weak which has prompted the provision of mechanical safety latches which are typically activated after attachment of a magnetic lock.

An example of a prior art clasp including magnets is disclosed in U.S. Pat. No. 9,101,185 B.

Objects of the jewelry clasps, pieces of jewelry, and methods according to the disclosure may involve one or more of enabling an easier or improved activation of jewelry clasp and/or an easier or improved release of the jewelry clasp, potentially with one hand only, and a more secure or safer attachment of ends of an elongated member of a piece of jewelry. Other objects may involve improved control of the jewelry clasps during their activation and release, as well as avoiding damage of fingernails during activation and release of the jewelry clasp.

SUMMARY

A first aspect of the disclosure involves a jewelry clasp for securing a first end of an elongated member of a bracelet or a necklace to a second end of the elongated member, the jewelry clasp comprising a female part and a male part;

wherein one of the female and male parts comprises a first magnet and the other of the female and male parts comprises a part magnetically attractable by the first magnet;

wherein the female part comprises a housing and a hinged lid, the hinged lid being pivotable between a locking state in which the female part is closed and a releasing state in which the female part is open; and wherein the hinged lid comprises the first magnet or the part magnetically attractable by the first magnet;

so that when the female part is open, the male part can be inserted in an axial direction into the housing, and when the female part is closed, and the male part is inserted into the housing, the male part is in a locked position in which the male part is locked to the female part.

The jewelry clasps, pieces of jewelry, and methods according to the disclosure may achieve one or more of enabling an easier or improved activation of the jewelry clasps and/or an easier or improved release of the jewelry clasps, potentially with one hand only, and/or a more secure or safer attachment of ends of an elongated member of a piece of jewelry. Improved control of the jewelry clasps during their activation and release and/or avoiding damage of fingernails during release of the jewelry clasps may also be achieved.

With the jewelry clasps according to the disclosure, a magnetic lock may be provided, which only provides a significant force on the lid when the male part is close to or inserted in the housing, which may make it easier to insert the male part into the housing.

Furthermore, the jewelry clasps may be provided so that the female part automatically opens due to magnetic repulsion when the male part is moved towards the female part, which may make it possible to more easily insert the male part into the housing, potentially using only one hand. After insertion of the male part into the housing, the closed lid may, furthermore, close automatically due to magnetic attraction.

A magnetic lock of the jewelry clasp may be combined with a mechanical security lock so that a more secure attachment of ends of an elongated member may be achieved.

The jewelry clasps according to the disclosure may be used in any suitable piece of jewelry, such as a bracelet or necklace. A bracelet may be defined as a piece of jewelry that is typically worn on the wrist of a user (a wrist bracelet), typically surrounding the wrist. A bracelet may also be worn on the ankle (an ankle bracelet or "anklet"), whereas a necklace is typically worn on the neck of a user.

The jewelry clasps of the disclosure may comprise or consist of metal, e.g. silver, iron, gold, brass, or alloys thereof, such as steel, plastic, plastic polymers, glass, precious stones or gemstones, wood, and ornamentations. The jewelry clasps may be intended to be hidden while worn or to form a key element in the design of the jewelry.

A shape of the female part and/or the assembled jewelry clasp may together form a substantially round and/or spherical, parallelepipedal, ellipsoidal, cylindrical or any other suitable shape.

The hinged lid may include a spacing or cut-out corresponding to or matching the or a magnet, the magnet being positioned in the spacing, potentially attached thereto, potentially by means of glue.

The magnet(s) may have a parallelepipedal or cylindrical shape.

In the context of the disclosure, a magnet may be defined as a material or object that produces a magnetic field. The magnet may be a permanent magnet. One magnet may be configured to magnetically attract and/or reject a second magnet and/or a ferromagnetic member and/or a magnetically attractable material. The one or more magnets of the jewelry clasps of the disclosure may have a cylindrical, annular, conical, spherical and/or parallelepipedal shape. The magnets may include several sub-magnets, e.g. a linked series of sub-magnets and/or ferrous beads. One or more of the magnets may have a width that is substantially equal to a length of the magnet, and/or a height of the one or more magnets may be smaller than a length and a width thereof. One or more of the magnets may consist of or comprise neodymium.

One or more of the magnets may be at least partly included or embedded in the female part and/or in the male part. One magnet may be located in or form part of the female part, and another or the other magnet may be located in or form part of the male part. One magnet may be positioned in a cut-out in an internal surface of the hinged lid and/or in a cut-out in an external surface of the male part. Opposite magnetic poles may be positioned facing and/or abutting each other when the male part is locked to the female part, i.e. when the clasp is in a closed position.

The male part may be brought to its attached position by attraction between the magnet and the magnetically attractable material and/or by opposite magnetic polarity between two magnets.

The elongated member may be or comprise a chain, such as a snake chain, wire, string, thread, chord, or the like. The elongated member may be a snake chain. The snake chain may comprise round, wavy, and/or smooth metal links that are joined to form a flexible chain. The elongated member may comprise or consist of one or more of the materials mentioned above. The elongated member may also be coated or plated, such as gold-plated. The elongated member, in particular an intermediate part thereof, may be flexible and/or elastic and/or resilient. The elongated member may be cylindrical and/or rigid and/or hollow. The elongated member may be flat and/or may be a strap-shaped member, which may be flexible, such as a flat, flexible chain. The elongated member may include or consist of interconnected or hinged joints, potentially chain joints.

The female part and/or the male part may comprise a cap with a spacing having an opening receiving and attaching an end of the elongated member, which may further comprise an intermediate, potentially flexible, part leading to a second end of the elongated member. The cap and/or the spacing and/or the opening may have a conical, frusto-conical, annular, spherical, cylindrical and/or parallelepipedal shape. Alternatively, one or both ends of the elongated member may be attached to the associated female part or male part in any other suitable way. For example, one or both ends may be in one piece or integral with and/or may be fixedly and/or permanently mounted in or to associated male or female part.

One or more of the magnets may be positioned with magnetic north and south poles thereof distributed along a radial direction. North and south poles of the magnets may face towards each other in the attached position of the male part.

The part magnetically attractable by the magnet may alternatively be a magnetizable material, such as a ferromagnetic material, such as iron, so that the magnetic attraction is achieved with only a single magnet. In the latter case, the part magnetically attractable by the magnet may also be considered to form a "magnet", at least when the first clasp part is in its attached position.

The magnet may in the attached position of the male part be held in abutment with the part magnetically attractable by the magnet.

An external shape of the male part may match a shape of an interior spacing of the female part when the hinged lid is closed.

A tip or front part of the male part or of the tongue(s) thereof, see below, may be bevelled, chamfered or pointed, which may allow easier or more controlled insertion of the male part into the female part, potentially in the groove(s) thereof. A rear part of the hinged lid may be bevelled or chamfered, which may allow for a pivoting opening movement of the hinged lid in relation to the housing.

When the female part is closed, and the male part is inserted into the housing, the male part may be locked, especially in the axial direction, to the female part by the lid. The female part may be closed or closeable by the hinged lid.

The housing may be for housing at least a portion of the male part in the locked position of the male part.

The housing may comprise an opening, the male part being inserted into the housing through the opening, wherein said opening in the locked position of the male part may further be at least partly covered by the hinged lid. This opening may comprise a front part and a top part, wherein the male part is inserted into the front part and the lid covers or closes the top part when the male part is attached to the female part. Each groove of the female part may comprise an opening coinciding with the front part of the opening. The opening and/or the female part and/or the housing may be closed or substantially closed when the male part is in the locked position.

The jewelry clasp may have a flat shape in the locking state of the hinged lid.

The hinged lid may be plate-shaped and/or may be hinged at one end.

The axial direction may be a longitudinal direction and/or may extend in a length direction of the elongated member. The axial direction may extend between two ends of the elongated member. The axial direction may be defined as an insertion or sliding direction of the male part. A radial direction extends perpendicularly to the axial direction.

The hinged lid may be pivotable and/or rotatable about a hinge axis and/or a hinge pin.

The housing may comprise two side walls, a rear wall, and a bottom wall, which together may define the opening of the housing.

The jewelry clasp may comprise a magnetic lock and a further, mechanical safety lock, see also below.

The disclosure further involves a method of releasing the male part of the jewelry clasp of any one of the above embodiments, the method comprising opening the hinged lid and extracting at least a part of the male part inserted in the housing from the housing.

A method of moving the male part to the locked position may comprise inserting at least part of the male part within the housing and closing the hinged lid, the closing of the hinged lid optionally being provided or assisted by magnetic attraction between the first and second magnets.

The hinged lid may be attached to the housing, potentially by a hinge pin. The hinged lid may comprise a front part and a rear part, the front part including the first magnet, and the rear part being positioned oppositely from the front part in relation to a hinge axis, in which case the method of releasing the male part may further comprise pushing the rear part, so that the hinged lid is opened. The rear part may extend above a rear wall of the housing.

In embodiments of the jewelry clasps according to the disclosure, the first magnet and the part magnetically attractable by the first magnet are magnetically attracted to each other when the male part is locked to the female part.

This may provide a magnetic locking of the male part to the female part.

In embodiments, the part magnetically attractable by the first magnet is a second magnet.

In a development of these embodiments, the female part automatically opens due to magnetic repulsion between the first magnet and the second magnet when the male part is moved towards the female part.

This may be achieved by a magnet in the hinged lid being rejected from a magnet in the male part when a user in a detached positioned of the male part brings the male part close to the opening of the female part. Before and potentially during part of the inserting movement of the male part, the opposite magnetic poles may reject the magnet of the hinged lid so that the hinged lid automatically opens the housing, potentially only by means of the magnetic repulsion between the two magnets. When the male part is then at least partly inserted into the housing, due to the now changed positioning of the magnets opposite magnetic poles of the magnets may then bring the hinged lid to automatically close by means of magnetic attraction.

Hereby, the wearer or user of the jewelry clasp may not need to use a hand to manipulate the female part, such as press or insert his/her fingernails into a cut-out, to open or close the female part. This may allow for an easier opening without risk of damaging the fingernails. The user may only need to bring the male part close to the opening, which causes the hinged lid to open the opening of the female part, after which the user can insert the male part, and the female part then automatically closes. The magnetic force bringing the first clasp part into its attached position may thus also have the advantage of an easier and faster closing of the jewelry clasp.

It may thus be possible to more easily insert the male part into the housing, potentially using only one hand. After insertion of the male part into the housing, the closed lid may, furthermore, close automatically due to magnetic attraction between the magnets.

Both magnets may comprise two opposite magnetic poles, wherein opposite magnetic poles of the two magnets attract each other in the locked position of the male part and so that these reject each other when the male part is not inserted in the female part and is positioned close to the opening of the housing.

In embodiments, the first magnet comprises a first surface, and the second magnet comprises a second surface, wherein in the locked position of the male part, the first and second surfaces face each other and extend in the axial direction.

A resultant magnetic attraction may occur in the radial direction. This may allow the lid to open and close automatically, as explained.

In embodiments, one of the male part and the female part comprises at least one tongue, and the other of the male part and the female part comprises at least one groove, wherein the male part is inserted into the housing by the at least one tongue sliding in the at least one groove.

The grooves may be provided on an inner side of a side wall of the housing.

The tongue may be a projection which may elongated and extend in the axial direction. The groove may be a track which may similarly be elongated and extend in the axial direction. The tongue may be inserted into the groove when the male part is inserted into the female part.

The or each tongue may be comprised in the male part, potentially formed by lateral edges of the male part. Accordingly, the male part may be shaped as a flat, potentially parallelepipedal plate. The or each groove may be comprised in the female part, potentially at lateral interior surfaces of a spacing for receiving the male part. The or each groove may be formed by associated two cut-outs in an interior surface of the female part.

The jewelry clasp may comprise two grooves, potentially of the female part, and two associated tongues, potentially of the male part, each tongue sliding in one of the grooves.

Two sets of each a tongue and a groove may be positioned at a distance from each other and extending radially outwards as well as in the axial direction.

The one or more tongues may be comprised in and may be in one piece with the male part, and the one or more grooves may be comprised in and may be in one piece with the male part.

Cooperation between the groove(s) and tongue(s) may prevent the male part from being removed from the female part in radial directions, while allowing the male part to be removed from the female part by sliding the male part in an axial direction.

In embodiments, the female part and the hinged lid form a parallelepipedal shape in the locking state of the hinged lid.

This shape may be substantially parallelepipedal.

In embodiments, the hinged lid is hinged by a hinge pin connecting the male part to the housing of the female part, said hinge pin allowing the hinged lid to pivot between the locking state and the releasing state.

The hinge pin may be provided as part of, potentially in one piece with, the hinged lid and/or part of the housing and/or separately from these. In the latter case, the hinge pin may be mounted at ends thereof in holes of the male part or the female part.

In embodiments, the jewelry clasp further comprises a mechanical safety lock comprising a first lock part of the hinged lid and a second lock part of the male part, wherein the first and second lock parts engage in the locked position of the male part to prevent the male part from being released from the female part.

In a development of these embodiments, the first or second lock part, in particular the first lock part, comprises a protrusion or projection, and the other lock part comprises a cut-out or depression, and the protrusion is inserted into the cut-out in the locked position of the male part.

Hereby, an axial movement of the male part may be prevented. The first lock part may be positioned at a front of the hinged lid. The second lock part may be positioned at a rear of the male part.

The protrusion may be provided on or in one piece with the hinged lid, and/or the cut-out on or as part of the male part.

In another aspect, the disclosure involves a jewelry clasp for securing a first end of an elongated member of a bracelet or a necklace to a second end of the elongated member, the jewelry clasp comprising a male part and a female part, wherein the female part comprises a first magnet, and the male part comprises a second magnet, and wherein the female part automatically opens due to magnetic repulsion between the first magnet and the second magnet when the male part is moved towards the female part.

In the jewelry clasp according to the aspect, the female part may comprise a housing and a part moveable in relation to the housing due to magnetic attraction and/or repulsion between the magnets. This moveable part may be a or the hinged lid. The hinged lid may be being pivotable between a locking state in which the female part is closed and a releasing state in which the female part is open. The hinged lid may comprise the first magnet, and the female part, especially the moveable part thereof, the second magnet.

Similar to what has been explained above, this may be achieved by a magnet in a hinged lid being rejected from a magnet in the male part when a user in a detached positioned of the male part brings the male part close to the opening of the female part. Before and potentially during part of the inserting movement of the male part, the opposite magnetic poles may reject the magnet of the hinged lid so that the hinged lid automatically opens the housing, potentially only by means of the magnetic repulsion between the two magnets. When the male part is then at least partly inserted into the housing, due to the now changed positioning of the magnets opposite magnetic poles of the magnets may then bring the hinged lid to automatically close by means of magnetic attraction.

Hereby, the wearer or user of the jewelry clasp may not need to use a hand to manipulate the female part, such as press or insert his/her fingernails into a cut-out, to open or close the female part. This may allow for an easier opening without risk of damaging the fingernails. The user may only need to bring the male part close to the opening, which causes the hinged lid to open the opening of the female part, after which the user can insert the male part, and the female part then automatically closes. The magnetic force bringing the male part into its attached position may thus also have the advantage of an easier and faster closing of the jewelry clasp.

The jewelry clasp according to an aspect may be according to any one or more of the embodiments of jewelry clasps as disclosed herein.

In another aspect, the disclosure involves a piece of jewelry comprising an elongated member and a jewelry clasp according to any one of the embodiments of jewelry clasps as disclosed herein, wherein the female part is attached to or is a first end of the elongated member, and the male part is attached to or is the second end of the elongated member, so that the clasp secures the first end to the second end when the male part is inserted to the housing.

In another aspect, the disclosure involves a method of opening the female part of the jewelry clasp of any one of the embodiments of jewelry clasps as disclosed herein, wherein the part magnetically attractable by the first magnet is a second magnet, the method comprising:

moving the male part of the jewelry clasp towards the female part in the axial direction, whereby the hinged lid automatically opens due to magnetic repulsion between the first magnet and the second magnet.

This method may further comprise inserting at least part of the male part within the housing and then potentially closing the hinged lid, the closing of the hinged lid optionally being provided or assisted by magnetic attraction between the first and second magnets.

In another aspect, the disclosure involves a method of opening a female part of a jewelry clasp for securing a first end of an elongated member of a bracelet or a necklace to a second end of the elongated member, wherein the jewelry clasp further comprises a male part, the female part comprises a first magnet, and the male part comprises a second magnet, the method comprising:

moving the male part towards the female part, whereby the female part automatically opens due to magnetic repulsion between the first magnet and the second magnet.

In the jewelry clasp according to the aspect, the female part may comprise a housing and a part moveable in relation to the housing due to magnetic attraction and/or repulsion between the magnets. This moveable part may be a or the hinged lid. The hinged lid may be being pivotable between a locking state in which the female part is closed and a releasing state in which the female part is open. The hinged lid may comprise the first magnet, and the female part, especially the moveable part thereof, the second magnet.

Again, similar to what has been explained above, this may be achieved by a magnet in a hinged lid being rejected from a magnet in the male part when a user in a detached positioned of the male part brings the male part close to the opening of the female part. Before and potentially during part of the inserting movement of the male part, the opposite magnetic poles may reject the magnet of the hinged lid so that the hinged lid automatically opens the housing, potentially only by means of the magnetic repulsion between the two magnets. When the male part is then at least partly inserted into the housing, due to the now changed positioning of the magnets opposite magnetic poles of the magnets may then bring the hinged lid to automatically close by means of magnetic attraction.

Hereby, the wearer or user of the jewelry clasp may not need to use a hand to manipulate the female part, such as press or insert his/her fingernails into a cut-out, to open or close the female part. This may allow for an easier opening without risk of damaging the fingernails. The user may only need to bring the male part close to the opening, which causes the hinged lid to open the opening of the female part, after which the user can insert the male part, and the female part then automatically closes. The magnetic force bringing the male part into its attached position may thus also have the advantage of an easier and faster closing of the jewelry clasp.

In the jewelry clasp of the methods described herein, the female part may comprise a housing and a part moveable in relation to the housing due to magnetic attraction and/or repulsion between the magnets. This moveable part may be a or the hinged lid. The hinged lid may be being pivotable between a locking state in which the female part is closed and a releasing state in which the female part is open. The hinged lid may comprise the first magnet, and the female part, especially the moveable part thereof, the second magnet.

In another aspect, a jewelry clasp is provided for securing a first end of an elongated member of a bracelet or a necklace to a second end of the elongated member, the jewelry clasp comprising a male part and a female part, wherein the female part comprises a first magnet, and the male part comprises a second magnet, and wherein the female part automatically opens due to magnetic repulsion between the first magnet and the second magnet when the male part is moved towards the female part.

In yet another aspect, the disclosure involves a method of opening a female part of a jewelry clasp for securing a first end of an elongated member of a bracelet or a necklace to a second end of the elongated member, wherein the jewelry clasp further comprises a male part, the female part comprises a first magnet, and the male part comprises a second magnet, the method comprising:

moving the male part towards the female part, whereby the female part automatically opens due to magnetic repulsion between the first magnet and the second magnet. The jewelry clasp according to present method may be according to any one of the embodiments of jewelry clasps as disclosed herein. Similarly, the methods according to the present disclosure may be carried out on the jewelry clasps of the pieces of jewelry as disclosed herein.

BRIEF DESCRIPTION OF THE DRAWINGS

Further embodiments and advantages of the jewelry clasps, pieces of jewelry, and methods according to the present disclosure are disclosed in the subsequent detailed description and in the drawings, in which.

DETAILED DESCRIPTION

Figure 1:
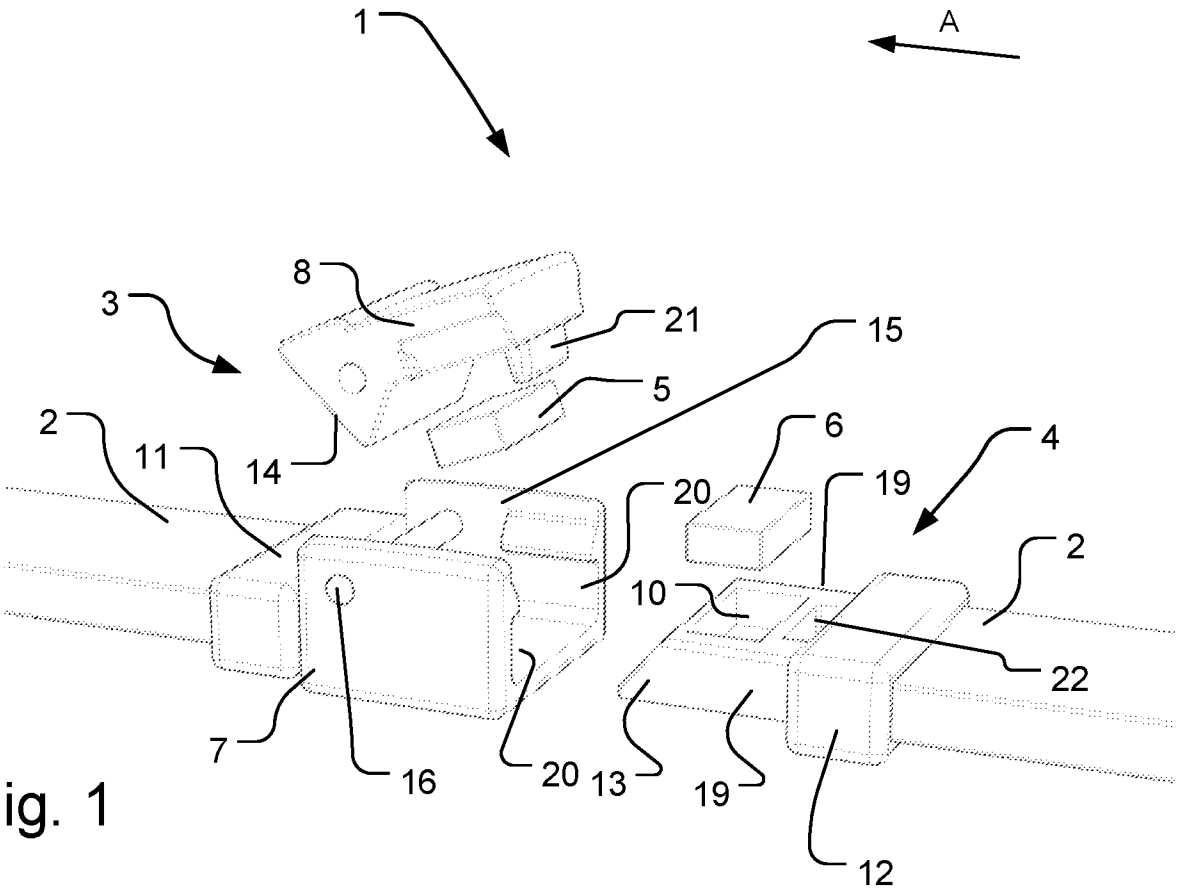
FIG. 1 is an exploded perspective view of an embodiment of the jewelry clasps according to the present disclosure, also showing parts of an elongated member of a piece of jewelry.
Figure 2:
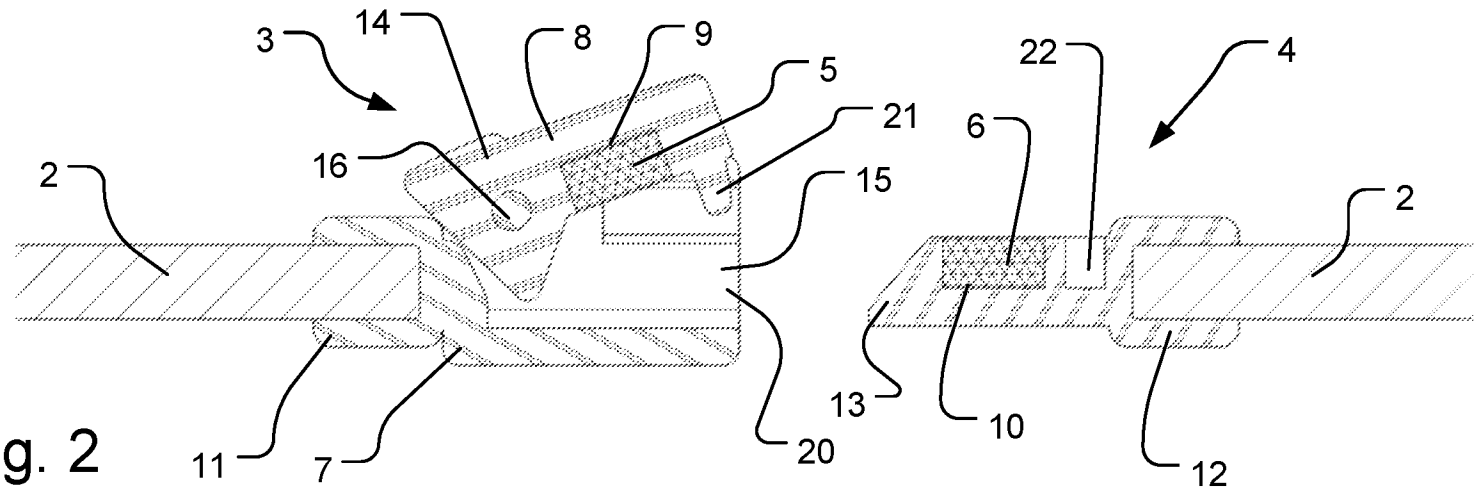
FIG. 2 is a cross-sectional side view of the jewelry clasp of FIG. 1 in an assembled condition, wherein a male part of the jewelry clasp is in a detached state.
Figure 3:
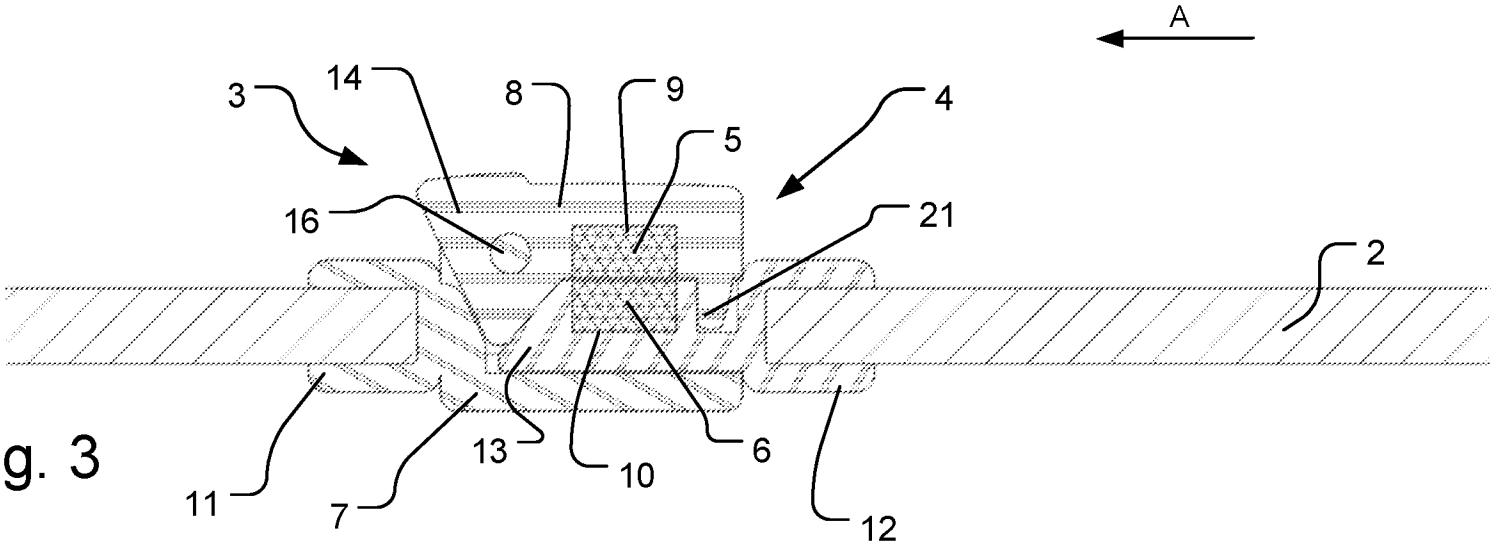
FIG. 3 is a view corresponding to that of FIG. 2, wherein the male part has been inserted into and locked to a female part of the jewelry clasp.
Figure 4:
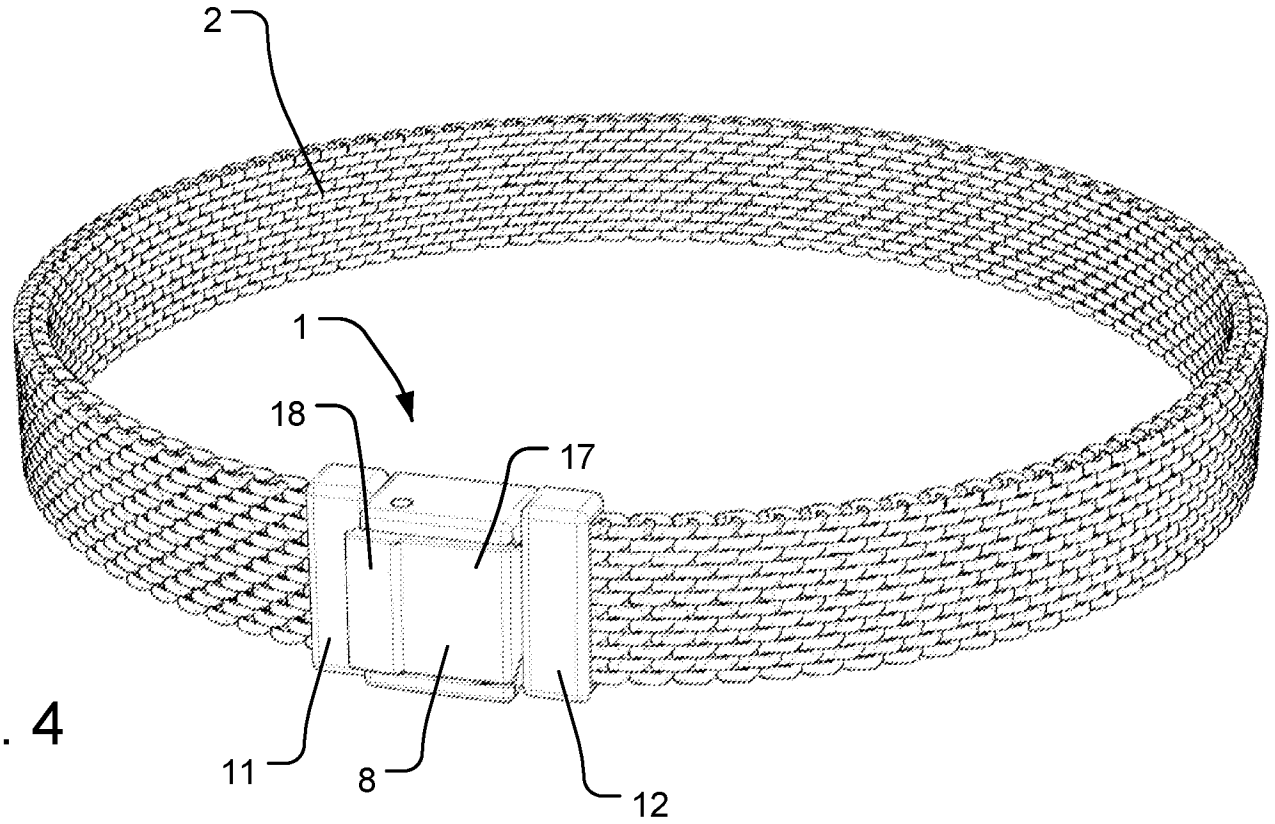
FIG. 4 is a perspective view of a bracelet comprising the jewelry clasp of FIG. 1, in which the male part is in a locked state.

FIGS. 1 to 7 show different views of a jewelry clasp 1 attached to ends of an elongated member in the form of a flat, flexible, metal strap chain 2 for forming a bracelet shown in its entirety in FIG. 4.

Referring to FIGS. 1 to 7, the jewelry clasp 1 is for securing a first end of the chain 2 to a second end thereof. The jewelry clasp 1 comprises a female part 3 and a male part 4. The female part 3 comprises a first magnet 5, and the male part 4 part comprises second magnet 6. The female part 3 comprises a housing 7 and a hinged lid 8. The hinged lid 8 is pivotable between a locking state, shown in FIGS. 3, 4, and 7, in which the female part 3 is closed, and a releasing state, shown in FIGS. 2 and 5, in which the female part 3 is open. The hinged lid 8 comprises the first magnet 5. Hereby, as will be explained further below, when the female part 3 is open, the male part 4 can be inserted in an axial direction A into the housing 7, and when the female part 3 is closed, and the male part 4 is inserted into the housing 7, the male part 4 is in a locked position in which the male part 4 is locked to the female part 3.

Figure 5:
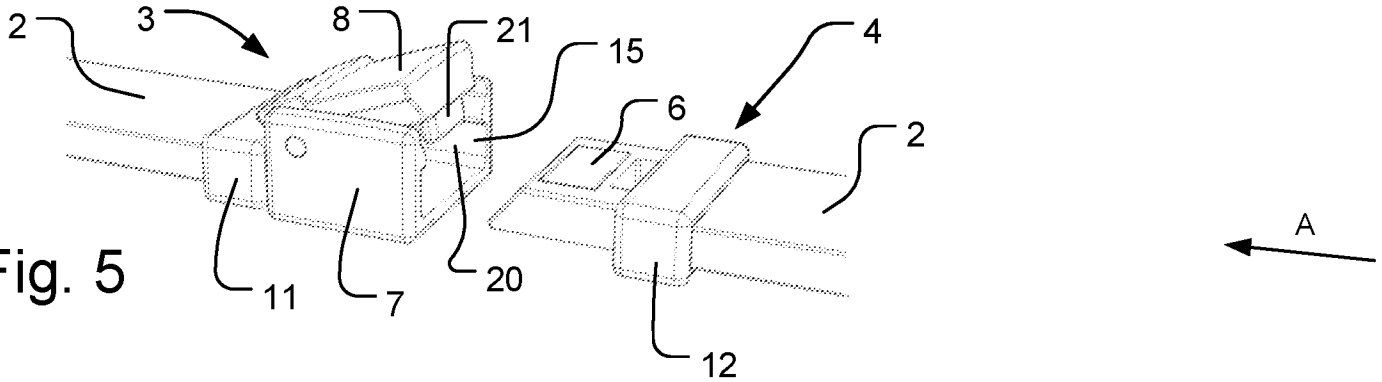
FIGS. 5 to 7 are perspective views of the jewelry clasp of FIG. 1, illustrating a method of locking the male part to the female part thereof.
Figure 6:
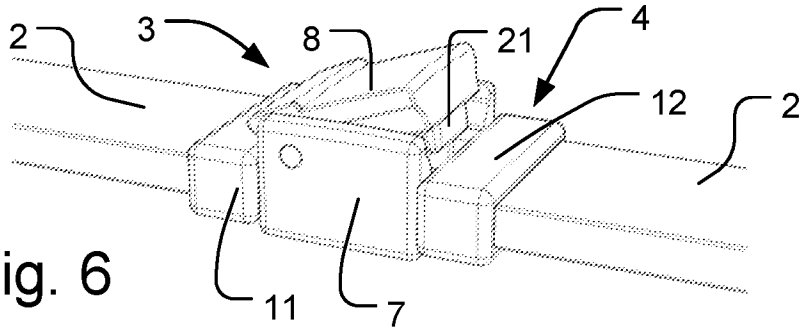
Figure 7:
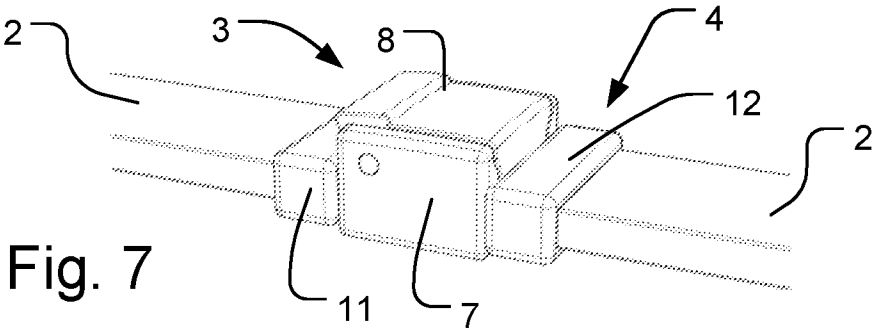

The magnets 5, 6 provide a magnetic lock, which only provides a significant force on the lid 8 when the male part 5 is close to or inserted in the housing, as shown in FIGS. 2 and 5, which makes it easier to insert the male part 6 into the housing 8. The female part 3 opens automatically due to magnetic repulsion between the magnets 5, 6 when the male part is moved towards the female part, as shown in FIGS. 2 and 5, which makes it possible to insert the male part into the housing, potentially using only one hand. After insertion of the male part into the housing, the closed lid closes automatically due to magnetic attraction between the magnets 5, 6.

A shape of the closed female part 3 is substantially parallelepipedal.

The hinged lid 8 includes a magnet spacing 9 matching the magnet 5, the magnet 5 being inserted and attached in the magnet spacing 9. The male part similarly includes a magnet spacing 10 in which the magnet 6 is inserted. The magnets 5, 6 and magnet spacings 9, 10 each have a parallelepipedal shape. The magnets 5, 6 are permanent magnets with heights smaller than lengths and widths thereof. Opposite magnetic poles of the magnets 5, 6 are positioned facing and abutting each other when the male part 4 is locked to the female part 3, i.e. when the clasp 1 is in its closed position. The male part 5 can be brought to its attached position by attraction between the magnets 5, 6.

The female part 3 and the male part 4 each comprises a cap 11, 12, respectively, each with a spacing having an opening receiving and attaching one end of the strap chain 2, see FIGS. 2 and 3. The caps 11, 12 and their spacings and the openings have a parallelepipedal shape corresponding to the shape of the strap chain 2.

The magnets 5, 6 are positioned with magnetic north and south poles thereof distributed along a radial direction extending perpendicularly to the axial direction A. North and south poles of the magnets 5, 6 face each other in the locked state of the male part 4. The magnets 5,6 are in the attached, locked position of the male part 4 held in abutment with each other, see FIG. 3.

An external shape of the male part 4 matches a shape of an interior spacing of the female part 3 when the hinged lid 8 is closed.

A tip part 13 of the male part 4 is chamfered to allow a more controlled insertion of the male part 4 into the female part 3. A rear part 14 of the hinged lid 8 is chamfered to allow for a pivoting opening movement of the hinged lid 8 in relation to the housing 7, see FIGS. 2 and 3.

When the female part 3 is closed, and the male part 4 is inserted into the housing 7, the male part 4 is locked in the axial direction A to the female part 3 by the lid 8. The female part 3 is closed by the lid 8.

The housing 7 comprises an opening 15. The male part is inserted into the housing through a front part of the opening 15. A top part of the opening 15 is covered and closed by the hinged lid in the locked position of the male part 4. The housing 7 comprises two side walls, a rear wall, and a bottom wall, which together define the opening 15.

The axial direction A is a longitudinal direction defined as an insertion or sliding direction of the male part 4.

The hinged lid 8 is plate-shaped and hinged at one end to be pivotable and rotatable about a hinge axis defined by a hinge pin 16. The lid 8 is attached to the housing 7 by the hinge pin 16. The lid 8 comprises a front part 17 and a rear part 18, the front part 17 including the first magnet 5, and the rear part 18 being positioned oppositely from the front part in relation to the hinge pin 16. The male part can be released by pushing the rear part, e.g. with a finger, so that the lid 8 is opened. The rear part 18 extends above the rear wall of the housing 7.

The magnets 5, 6 are magnetically attracted to each other when the male part 4 is locked to the female part 3, which provides a magnetic locking of the male part 4 to the female part 3.

The female part opens automatically due to magnetic repulsion between the magnet 5, 6 when the male part 4 is moved towards the female part 3 as shown in FIGS. 2 and 5. This is achieved by the magnet 5 being rejected from the magnet 6 when a user in a detached positioned of the male part 4 brings the male part 4 close to the front part of the opening 15 of the female part 3. The same magnetic poles of the magnets 5, 6, i.e. either the magnetic south or magnetic north poles, reject the magnet 5 so that the hinged lid 8 automatically pivots open by means of the magnetic repulsion between the two magnets 5, 6. When the male part 4 is then further inserted into the housing 7, due to the now changed positioning of the magnets 5, 6, opposite magnetic poles of the magnets 5, 6 bring the lid 8 to automatically close by means of the now magnetic attraction between the magnets 5, 6.

Hereby, the wearer or user of the jewelry clasp 1 need not to use a hand to manipulate the female part 3 during insertion of the male part 4, such as press or insert his/her fingernails into a cut-out, to open or close the female part 3. Manipulation of the female part 3 is not necessary to open the female part 3. The wearer need only bring the male part 4 close to the front part of the opening 15, which causes the lid 8 to pivot open, after which the wearer can slide in the male part 4, after or during which the female part 3 then automatically closes.

The magnets 5, 6 comprise associated surfaces which, in the locked position of the male part, face and abut each other and extend in the axial direction A. The resultant magnetic attraction in the locked state of the male part 4 occurs in the radial direction which allows the lid to 8 open and close automatically, as explained.

The male part 4 comprises two tongues 19, and the housing 7 comprises two corresponding grooves 20. The male part 4 is inserted into the housing 8 by the tongues 19 sliding in the associated groove 20. The grooves 20 are provided on inner sides of the side walls of the housing 7. The tongues are elongated and extend in the axial direction A. The grooves are elongated tracks also extending in the axial direction A. The tongues 19 are inserted into the grooves 20 when the male part 4 is inserted into the housing 8. The tongues are formed by lateral edges of the male part 4, the male part 4 being shaped as a flat, potentially parallelepipedal plate. The grooves are provided at lateral interior surfaces of an interior spacing of the female part 3 for receiving the male part 4. The two sets of tongue 19 and groove 20 are positioned at a distance from each other and extending in the radial direction as well as in the axial direction A.

Cooperation between the grooves 20 and tongues 19 prevents the male part 4 from being removed from the female part 3 in radial directions, while allowing the male part 4 to be removed from the female part 3 by sliding the male part 4 in an axial direction A.

The female part forms a parallelepipedal shape in the locking state of the lid 8.

The hinged lid is hinged by the hinge pin 16 connecting the male part 4 to the housing 8, the hinge pin 16 allowing the lid 8 to pivot between the locking state and the releasing state of the male part 4. The hinge pin 16 is provided separately from the lid 8 and housing 7 and is mounted at ends of the hinge pin 16 in holes of the housing 7. The hinge pin 16 extends through the rear part 14 of the hinged lid 8.

The jewelry clasp 1 further comprises a mechanical safety lock comprising a first lock part of the lid 8 and a second lock part of the male part 4. The first lock part is a protrusion 21 protruding from a bottom surface at a front of and in one piece with the lid 8, and the second lock part is a cut-out 22 in a top surface at a rear of the male part 4. The protrusion 21 is inserted into the cut-out 22 in the locked position of the male part 4 to prevent the male part from being released (pulled out in a direction opposed to the axial direction A) from the female part 3.

LIST OF REFERENCE SIGNS

1 Jewelry clasp
2 Strap chain
3 Female part
4 Male part
5 First magnet
6 Second magnet
7 Housing
8 Hinged lid
9 Magnet spacing
10 Magnet spacing
11 Cap
12 Cap
13 Tip part
14 Rear part
15 Opening of housing 7
16 Hinge pin
17 Front part of lid 8
18 Rear part of lid 8
19 Tongues
20 Grooves
21 Protrusion
22 Cut-out for protrusion 21
A Axial direction

The invention claimed is:

1. A jewelry clasp for securing a first end of an elongated member of a bracelet or a necklace to a second end of the elongated member, the jewelry clasp comprising a female part and a male part;

wherein one of the female and male parts comprises a first magnet and the other of the female and male parts comprises a part magnetically attractable by the first magnet;

wherein the female part comprises a housing and a hinged lid, the hinged lid being pivotable between a locking state in which the female part is closed and a releasing state in which the female part is open; and wherein the hinged lid comprises the first magnet or the part magnetically attractable by the first magnet;

so that when the female part is open, the male part can be inserted in an axial direction into the housing, and when the female part is closed, and the male part is inserted into the housing, the male part is in a locked position in which the male part is locked to the female part;

wherein the first magnet and the part magnetically attractable by the first magnet are magnetically attracted to each other when the male part is locked to the female part and the part magnetically attractable by the first magnet is a second magnet; and wherein the female part automatically opens due to magnetic repulsion between the first magnet and the second magnet when the male part is moved towards the female part.

2. The jewelry clasp of claim 1, wherein the first magnet comprises a first surface, and the second magnet comprises a second surface, wherein in the locked position of the male part, the first and second surfaces face each other and extend in the axial direction.

3. The jewelry clasp of claim 1, wherein one of the male part and the female part comprises at least one tongue, and the other of the male part and the female part comprises at least one groove, and wherein the male part is inserted into the housing by the at least one tongue sliding in the at least one groove.

4. The jewelry clasp of claim 1, wherein the female part and the hinged lid form a parallelepipedal shape in the locking state of the hinged lid.

5. The jewelry clasp of claim 1, wherein the hinged lid is hinged by a hinge pin for connecting the male part to the housing of the female part, said hinge pin allowing the hinged lid to pivot between the locking state and the releasing state.

6. The jewelry clasp of claim 1, wherein the jewelry clasp further comprises a mechanical safety lock comprising a first lock part of the hinged lid and a second lock part of the male part, wherein the first and second lock parts engage in the locked position of the male part to prevent the male part from being released from the female part.

7. The jewelry clasp of claim 6, wherein the first or second lock part comprises a protrusion, and the other lock part comprises a cut-out, and the protrusion is inserted into the cut-out in the locked position of the male part, such that an axial movement is prevented.

8. A piece of jewelry comprising an elongated member and a jewelry clasp according to claim 1, wherein the female part is attached to or is a first end of the elongated member, and the male part is attached to or is the second end of the elongated member, so that the clasp secures the first end to the second end when the male part is inserted to the housing.

9. A method of opening the female part of the jewelry clasp of claim 1, wherein the part magnetically attractable by the first magnet is a second magnet, the method comprising:

moving the male part of the jewelry clasp towards the female part in the axial direction, whereby the hinged lid automatically opens due to magnetic repulsion between the first magnet and the second magnet.

10. A method of locking the jewelry clasp of claim 1, the method comprising:

moving the male part to the locked position, inserting at least part of the male part within the housing and closing the hinged lid, the closing of the hinged lid optionally being provided or assisted by magnetic attraction between the first and second magnets.

11. A method of unlocking the jewelry clasp of claim 1, the method comprising:

releasing the male part by pushing the hinged lid of the female part, removing the male part from the female part by sliding the male part in an axial direction.

* * * * *